US005745993A

United States Patent [19]

Adachi et al.

[11] Patent Number: 5,745,993

[45] Date of Patent: May 5, 1998

[54] VALVE SEAT

[75] Inventors: Shuhei Adachi; Junichi Inami, both of Iwata, Japan

[73] Assignee: Yamaha Hatsudoki Kabushiki Kaisha, Iwata, Japan

[21] Appl. No.: 742,090

[22] Filed: Oct. 31, 1996

Related U.S. Application Data

[62] Division of Ser. No. 607,823, Feb. 27, 1996.

[51] Int. Cl.[6] ..... B23P 13/00

[52] U.S. Cl. ..... 29/888.44

[58] Field of Search ..... 123/188.8; 29/888.44, 29/888.06, 888.4

[56] References Cited

U.S. PATENT DOCUMENTS

| | | | |
|---|---|---|---|
| 3,428,035 | 2/1969 | Stefan et al. . | |
| 4,248,191 | 2/1981 | Albert | 123/188.8 |
| 4,336,432 | 6/1982 | Bajorek | 29/888.44 |
| 4,502,433 | 3/1985 | Becker, Jr. et al. . | |
| 4,522,161 | 6/1985 | Slee | 29/888.44 |
| 4,570,585 | 2/1986 | Hayashi | 123/188.8 |
| 4,791,259 | 12/1988 | Pfaffmann | 123/188.8 |
| 4,831,976 | 5/1989 | Pozniak et al. | 123/188.8 |
| 4,896,638 | 1/1990 | Shepley | 123/188.8 |
| 5,492,091 | 2/1996 | Russ | 123/188.8 |
| 5,586,530 | 12/1996 | Adachi et al. | 123/188.8 |

FOREIGN PATENT DOCUMENTS

| | | |
|---|---|---|
| 0064367 | 11/1982 | European Pat. Off. . |
| 0092683 | 11/1983 | European Pat. Off. . |
| 0228282 | 7/1987 | European Pat. Off. . |

OTHER PUBLICATIONS

European Search Report dated Jun. 16, 1996.

*Primary Examiner*—Erick R. Solis
*Attorney, Agent, or Firm*—Knobbe, Martens, Olson & Bear LLP

[57] ABSTRACT

A method of forming and a cylinder head for a reciprocating machine wherein the valve seat inserts can be formed from relatively small insert rings. The insert rings are fixed in place and are configured so that the end of the passage terminating in the chamber of the machine has substantially no straight sections and progressively increases in diameter toward the chamber which it serves.

3 Claims, 6 Drawing Sheets

VALVE SEAT

This application is a divisional of U.S. patent application Ser. No. 08/607,823, filed Feb. 27, 1996.

BACKGROUND OF THE INVENTION

This invention relates to a valve seat and, more particularly, to an improved valve seat arrangement for the cylinder head of a reciprocating machine.

Many forms of reciprocating machine include flow passages that extend through a component of the machine and which communicate with the variable volume chamber of the machine through a valve port or seat. The flow through this valve port or seat may be controlled by a poppet-type valve having a head portion that engages a seating surface for opening and closing the port.

With many types of machines, the body in which the passage is formed is made from a material that is dissimilar from that of the actual valve seat or valve seat insert. This is accomplished by providing an insert piece, generally in the form a ring, that is somehow adhered to the basic body material of the machine and held in place therein. Press fits are normally utilized for this purpose. There are certain disadvantages with this type of construction that may be understood by reference to FIG. 1.

FIG. 1 is a cross-sectional view taken through the valve seat and flow passage of a cylinder head, indicated generally by the reference numeral 11, of an internal combustion engine, which is typical of the type of reciprocating machine in which the problem to be described exists. The cylinder head 11 has a surface 12 which surface is generally formed as a recess in the lower cylinder head surface that mates with an associated cylinder block (not shown).

This surface 12 cooperates with the cylinder bore formed in the cylinder block and a piston reciprocating in the cylinder bore to form the combustion chamber of the engine. As is well known, the volume of this combustion chamber varies cyclically during the operation of the machine.

The cylinder head 11 may be formed from a suitable material and frequently aluminum or aluminum alloys are utilized for this purpose. One or more flow passages 13 extend through the cylinder head 11 from the surface 12 to an external surface. The flow passages 13 may constitute either intake passages or exhaust passages.

The flow through the passage 13 is controlled by a poppet-type valve, indicated generally by the reference number 14 and which has a head portion 15 having a seating surface 16 that is adapted to cooperate with a corresponding seating surface 17 of a valve seat formed in primary part by a valve seat insert 18. The valve seat insert 18 is formed from a material dissimilar from that of the basic cylinder head 11 and preferably a material that will have better strength and machining properties. Sintered metals are frequently employed for this purpose.

In order to accommodate the valve seat insert 18, the cylinder head 11 is formed with a machined recessed opening, indicated generally by the reference numeral 19 at one end 21 of the flow passage 13 adjacent the surface 12. The recessed opening 19 has a machined base surface 22 that extends generally parallel to the cylinder head surface 12 and a cylindrical portion 23. The insert 18 is affixed in this recess 19 normally by some form of press fitting.

This type of construction has a number of disadvantages which will now be described. The first of these is that, since the insert piece 18 must be pressed into place, it is necessary to have the recess 19 formed of a fairly large diameter and also to have a fairly deep recess into the surface 12. This is necessary to ensure that the insert piece 18 will not be damaged when it is press fit into place.

As a result of this construction, the basic height of the cylinder head 11 is increased so as to accommodate the respective recesses 19. This presents problems, particularly with vehicle applications. In automotive engines, this requires a higher hood line. In vehicles, such as motorcycles, the increase in engine height raises the seat height and that also is not desirable.

In addition, because of the large diameter of the diameter of the portion 23, it is difficult to provide multiple valve seats per combustion chamber. The reason for this is that the base material of the cylinder head 11 between adjacent valve seats must be left sufficiently large to avoid cracking either when the inserts 18 are installed or during operation of the machine.

Also, this configuration means that the cylinder head cooling jackets, if the cylinder head is water cooled, are spaced substantial distances from the heads 14 of the poppet valves 15. This reduces the ability to convey heat away from the poppet valves and, thus, requires the use of heavier poppet valves and larger diameter stems. Heavier valves dictate the use of stiffer valve springs and further decrease the efficiency of the engine or machine.

Furthermore, the configuration requires the induction passage 13 to have a flow portion 24 which leads up to and includes the valve seat insert seating surface 17 that extends generally straight. As a result, it is difficult to configure the cylinder head passages 13 so as to obtain the desired flow pattern for the charge entering the combustion chamber.

This is particularly disadvantageous in the formation of the intake passages. At times, it is desirable to have a generally curved configuration leading up to the valve seats 17. By doing so, the flow direction can be better controlled and the configuration can be utilized to obtain types of flow characteristics, such as tumble in the combustion chamber. Furthermore, the straight sections 24 tend to restrict the total flow into the combustion chamber.

It is, therefore, a principal objection of this invention to provide an improved valve seat arrangement for a reciprocating machine.

It is a further objection of this invention to provide an improved valve seat arrangement for a reciprocating machine that can utilize relatively small insert pieces so as to offer more flexibility in the configuration of the intake passages, better cooling, and the use of larger and more ports without the risk of damage to the cylinder head.

It is a further objection of this invention to provide an improved method for forming a cylinder head that will obtain all of these advantages.

SUMMARY OF THE INVENTION

This invention is adapted to be embodied in a cylinder head for a reciprocating machine. The cylinder head has a first external surface that forms at least, in part, a chamber of the reciprocating machine that varies cyclically in volume during the operation of the machine. A flow passages extends between the first external surface and a second external surface of the cylinder head for interchanging fluids with the chamber through the flow passage. The flow passage terminates in the chamber in a valve seat. The flow through the valve seat is controlled by a head of a poppet-type valve. The valve seat is defined in substantial part by an insert ring formed a material dissimilar from the base material of the cylinder head. The insert ring has a flow opening that forms a continuation of the cylinder head flow passage.

In accordance with a first feature of the invention, the insert piece opening and the adjacent portion of the cylinder head passage have a diameter that is greater than the normal throat diameter of the flow passage.

In accordance with another feature of the invention, the flow passage, at least in the area of the valve seat, has substantially no straight portion.

In accordance with a still further feature of the invention, the final flow opening of the insert ring is relatively short and increases in effective flow area in a direction extending toward the cylinder head first surface.

A further feature of the invention is adapted to be embodied in a method for forming a cylinder head for a reciprocating machine having a flow passage as described above. The method comprises the steps of forming a cylinder head casting having flow passage that terminates in the cylinder head first surface and the end of which is formed with a progressively increasing diameter portion that is formed with a recess that is adapted to receive the insert ring. The insert ring is bonded in place in this recess. The insert ring and cylinder head are then machined so as to form a valve seating surface that is adapted to be engaged by and sealed by a poppet type valve. The smallest diameter of this valve seating surface is complementary to the finished diameter of the adjacent tapered portion of the recess of the cylinder head material.

DETAILED DESCRIPTION OF THE PREFERRED EMBODIMENT OF THE INVENTION

Figure 2:
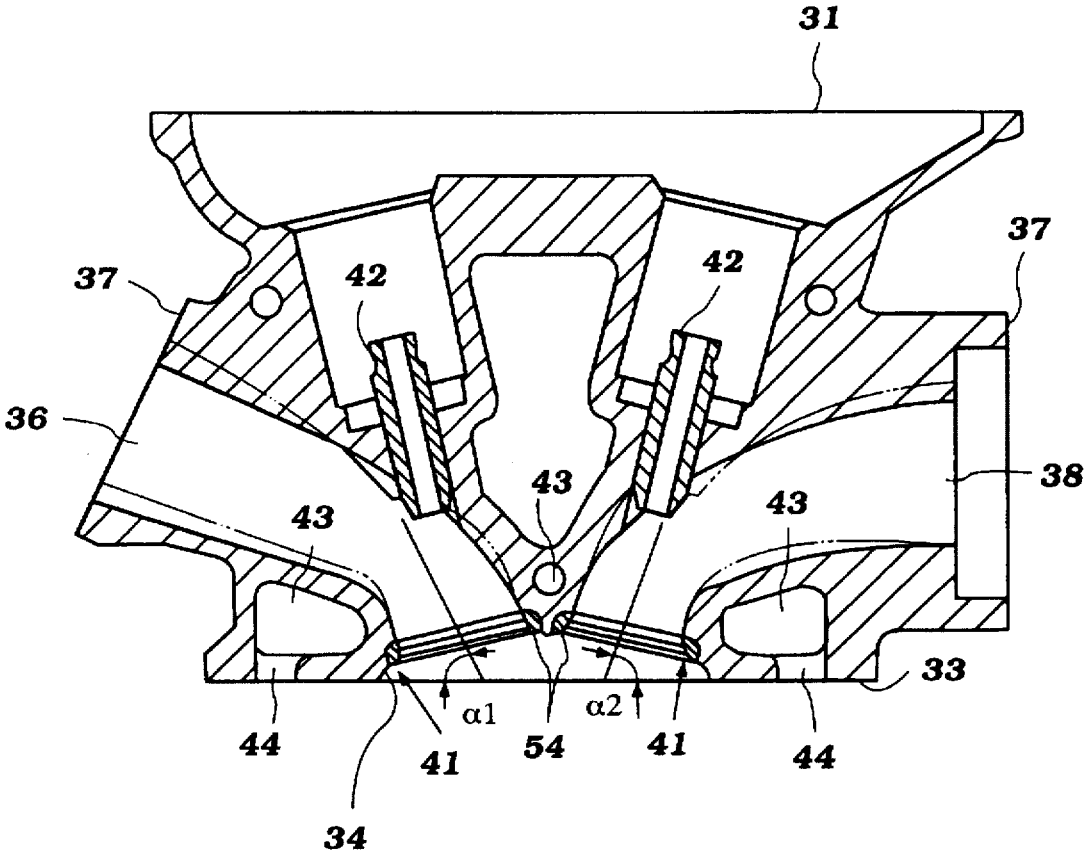
FIG. 2 is a cross-sectional view of a cylinder head that is constructed in accordance with an embodiment of the invention.
Figure 3:
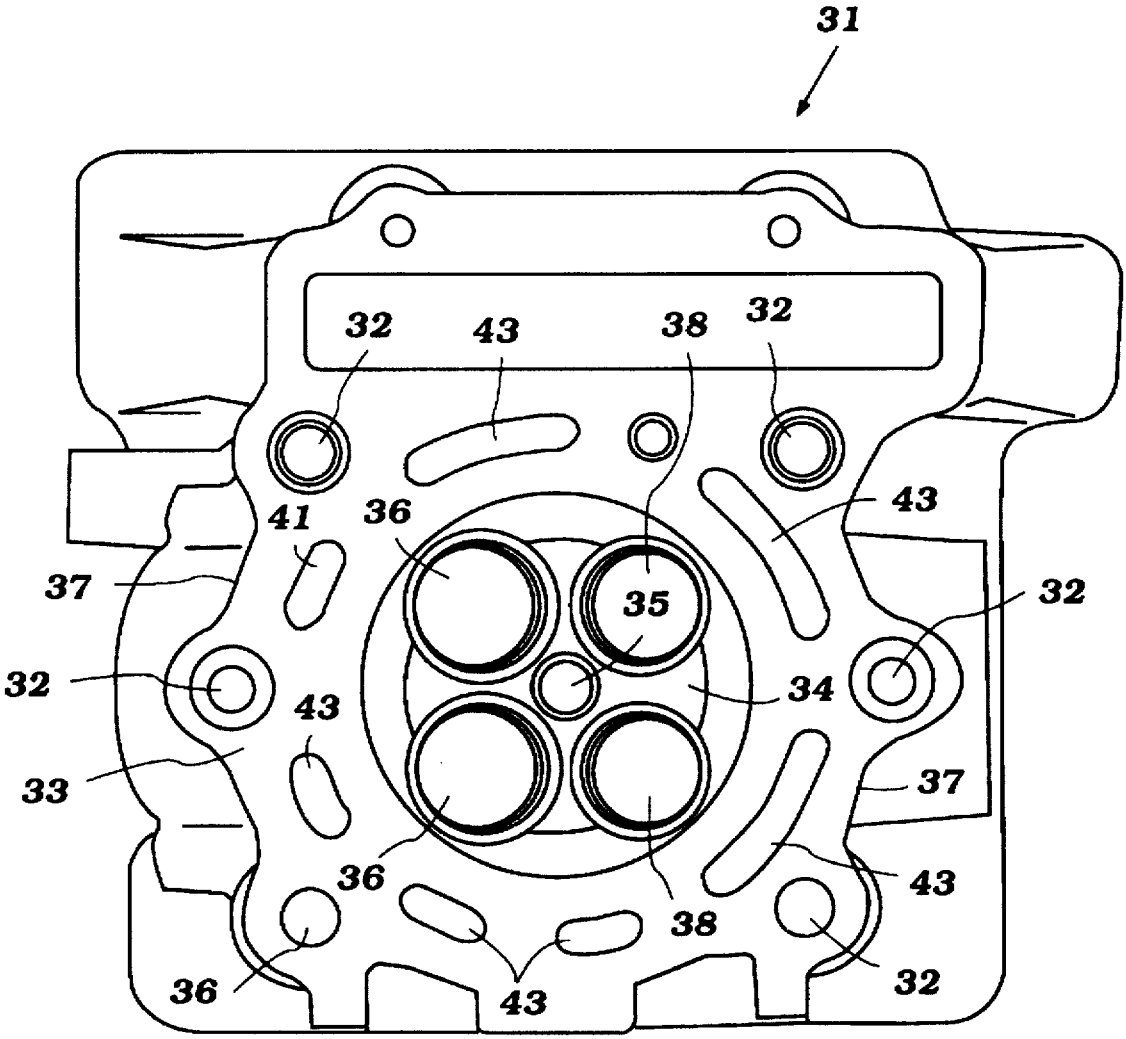
FIG. 3 is a bottom plan view of the cylinder head of FIG. 2.

Referring now in detail to the drawings and initially to FIGS. 2 and 3, a cylinder head constructed in accordance with an embodiment of the invention is indicated by the reference numeral 31. The cylinder head 31 may be formed from any suitable material such as aluminum or an aluminum alloy and comprises the upper portion of a reciprocating machine or engine the remainder of which is not shown.

The cylinder head 31 is affixed by bolts or studs (not shown) which pass through bolt holes 32 that are formed in the cylinder head 31 to an associated cylinder block (not shown). The cylinder head 31 has a lower sealing or first external surface 33 that engage the upper surface of the cylinder block and which is sealed thereto as is well known in the art.

A recessed surface 34 is defined within the first external surface 33 and cooperates with a cylinder bore formed in the cylinder block and a piston (not shown) which reciprocates therein to define a combustion chamber whose volume varies cyclically during the operation of the engine. A spark plug (not shown) is mounted within the cylinder head 31 and has its gap extending into the combustion chamber through an opening 35 formed in the recessed surface 34.

A pair of flow passages is indicated by the reference numeral 36 and open to the recessed surface 34. The passages 36 serve as means for interchanging fluids with the combustion chamber and extend through the cylinder head 31 and terminate at a second external surface 37 of the cylinder head 31. The flow passages 36 comprise intake passages in the illustrated embodiment.

In like manner, a pair of exhaust flow passages are indicated by the reference numeral 38 and also serve as a means for interchanging fluids with the combustion chamber. The exhaust flow passages 38 open to the recessed surface 34 on the side opposite the intake flow passages 36 and extend through the cylinder head 31 and terminate on the opposite side of the second external surface 37.

The flow through the intake and exhaust flow passages 36 and 38, respectively, is controlled by intake and exhaust poppet-type valves (not shown), each of which has a head portion that cooperate with a respective valve seat 41 that is formed at the lower ends of the flow passages 36 and 38 and will be discussed in detail later. The poppet-type valves have stem portions that are reciprocally supported within respective valve guides 42 that partially extend into the flow passages 36 and 38 of the cylinder head 31 and are affixed thereto in a known manner.

Water jackets are indicated by the reference numeral 43 and are formed within the cylinder head 31 in part between the lower ends of the flow passages 36 and 38 and serve to cool the cylinder head 31. The water jackets 43 are also connected by means of conduits 44 to further water jackets that are formed within and cool the cylinder block of the reciprocating machine or engine.

Figure 1:
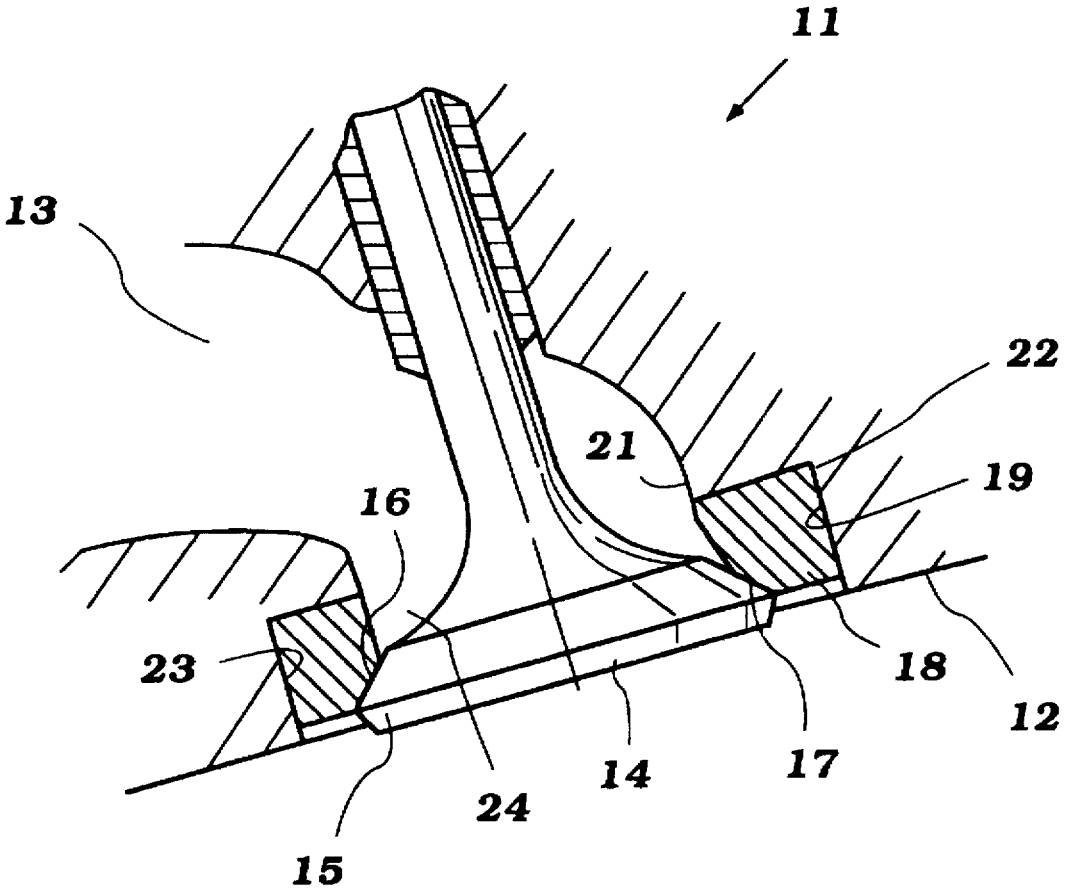
Figure 1 Prior Art
FIG. 1 is a partial cross-sectional view of the valve seat and flow passage of a cylinder head that is of conventional, prior art design.

The construction of the cylinder head 31 as thus far described is conventional and comparable to the cylinder head illustrated in FIG. 1 which utilizes a valve insert ring 18 to form the valve seat of a conventional design and which, as noted, is press-fit within the flow passage 13. As noted, a number of problems exist with the conventional type of press-fit valve seat configuration.

Because the valve insert ring 18 is press-fitted within the flow passage 13 the insert ring 18 must be of a construction sufficiently robust so as not to fracture during the press-fitting process. This necessitates a larger insert ring whose width and height can adversely compromise the design of the cylinder head. The larger width of the insert ring 18 creates problems for cylinder heads of multi-valve configuration since the distance between successive insert rings is minimal and cracks may form in the limited cylinder head material between the respective insert rings 18.

Also the wider insert rings 18 necessitates the placement of the water jackets further away from the combustion chamber which reduces their cooling effect on the valves 14. This, in turn, necessitates the utilization of larger, heavier valves.

And finally the larger height of the insert ring 18 forces the initial portion of the flow passages 13 to extend generally straight relative to the cylinder bore and with a relatively constant throat diameter. This increases the overall height of the engine and also adversely effects the flow characteristics of the flow passages, especially the intake passages. The constant throat diameter of the straight portion of the intake passages 36 restrict the total flow into the combustion chamber.

These problems can be seen in FIG. 2 where the dashed lines represent flow passages of conventional design. The straight sections force the flow passages 36 to bend sharply immediately above the valve seat area and adversely effects the flow through the flow passages. The straight sections of the intake and exhaust flow passages 36 and 38 respectively also tends to direct the flow into and out of the combustion chamber at larger angles of $\alpha 1$ and $\alpha 2$, respectively, that are measured relative to the first external surface 33 of the cylinder head 31.

The larger angle of $\alpha 1$ prevents the generation of a tumbling type flow into the combustion chamber which flow is known to improve the burning efficiency in the combustion chamber at low speeds and loads. This also increases the height of the cylinder head.

Figure 4:
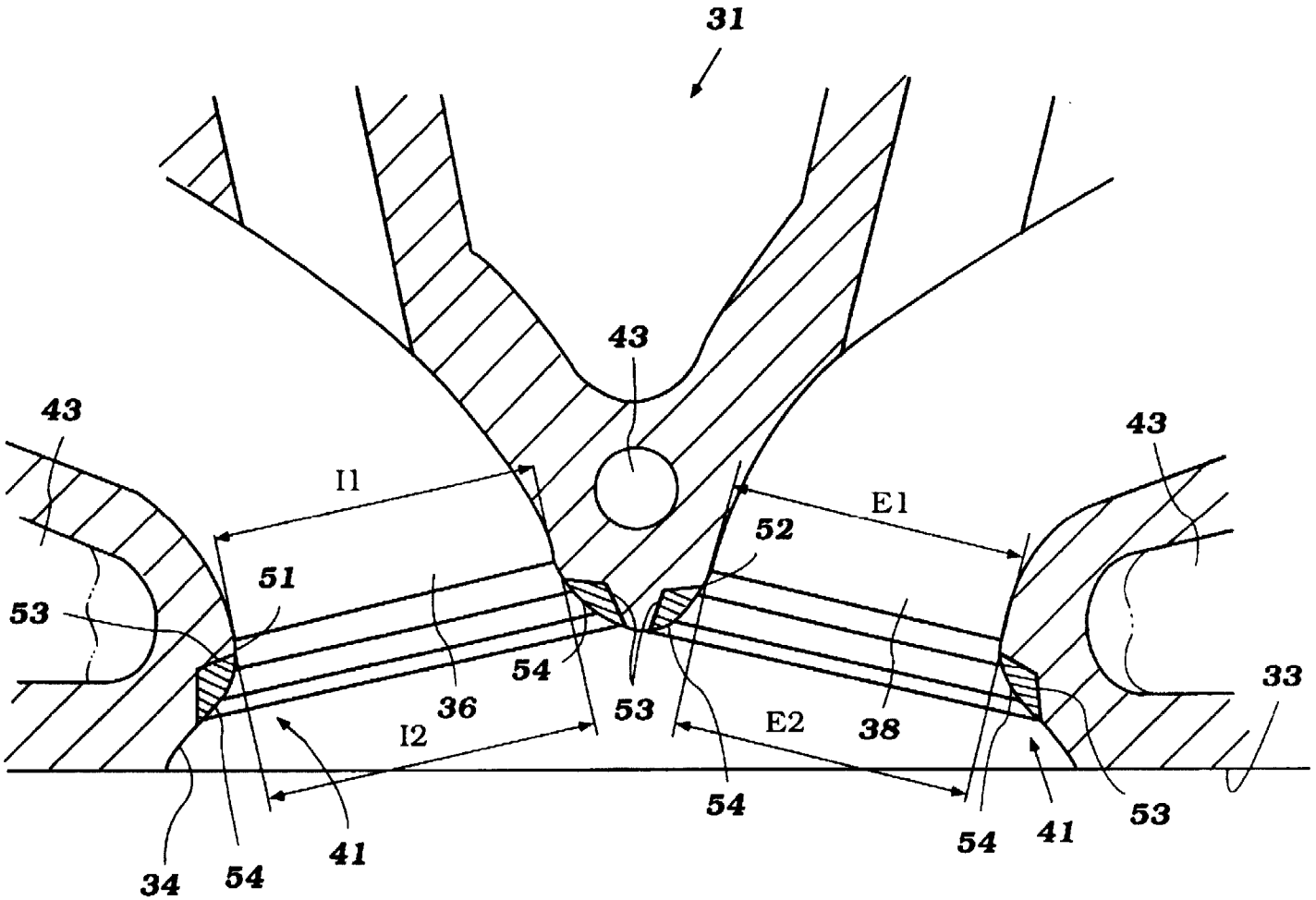
FIG. 4 is an enlarged cross-sectional view of the area of the valve seats as shown in FIG. 2.

The invention, now to be described eliminates the above adverse conditions by permitting the utilization of an insert ring whose dimensions are sufficiently small and of such a shape so as to avoid those cylinder head design compromises necessary when utilizing the insert rings of conventional configurations. This invention will now be described with additional reference initially to FIG. 4.

As seen in this figure, the lower ends of the intake and exhaust flow passages 36 and 38, respectively, terminate at valve seats 41 in which are formed tapered sections that are indicated by the reference numerals 51 and 52, respectively. The upper end of the intake passage tapered surface 51 has a throat diameter I1 that is less than the throat diameter I2 at its lower end. In like manner, the upper end of the exhaust flow passage tapered surface 52 has a throat diameter E1 that is less than the throat diameter E2 at its lower end.

Recesses 53 are disposed in the flow passages 36 and 38 immediately below and adjacent to the lower ends of the tapered surfaces 51 and 52 to which are joined, by a method to be described in detail later, intake and exhaust valve insert rings that are indicated by the reference numeral 54.

The insert rings 54 are formed from a material that is dissimilar to that of the cylinder head 11. Preferably they are formed by a sintering process and from a powdered material high in ferrous content. This material has a hardness greater than that of the cylinder head material. Also a metal such as copper or other materials having high electrical conductivity are added by infiltration treatment.

The insert rings 54 have flow openings that form continuations of the flow passages 36 and 38 and to which the heads of the intake and exhaust valves are seated. The upper diameters of the insert rings 54 are identical to the lower throat diameters I2 and E2 of their respective flow passages tapered sections while their lower throat diameters are identical to the throat diameters of the lower ends of the recesses 53. In other words, the lower throat diameters are larger than the upper throat diameters and the inserts 54 are formed flush with the flow passages 36 and 38 at their upper ends and recess 34 at their lower ends with a flow opening surface of a smooth contour that tapers outwardly.

Figure 5:
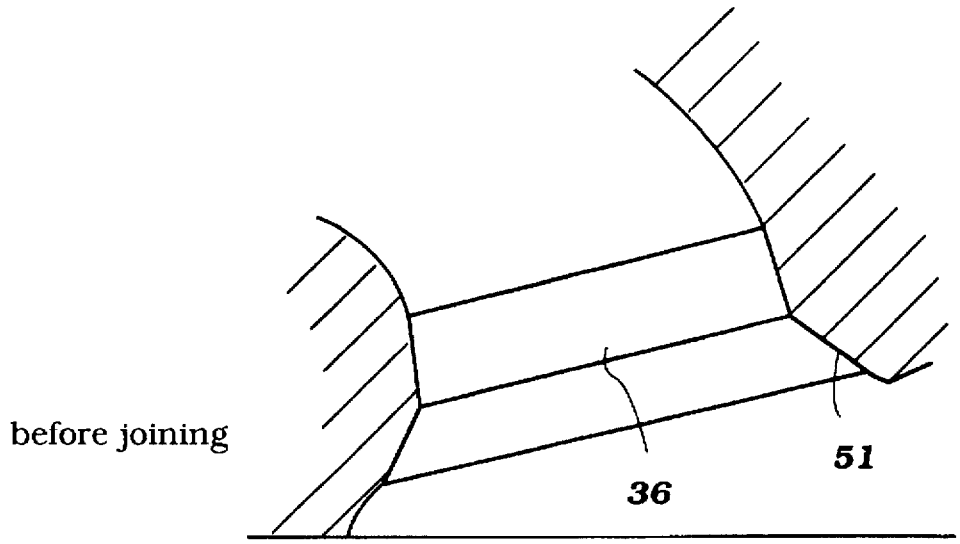
FIG. 5 is a cross-sectional view of the valve seat area for an intake flow passage and illustrates the condition before the cylinder head is machined and before the insert is installed.
Figure 6:
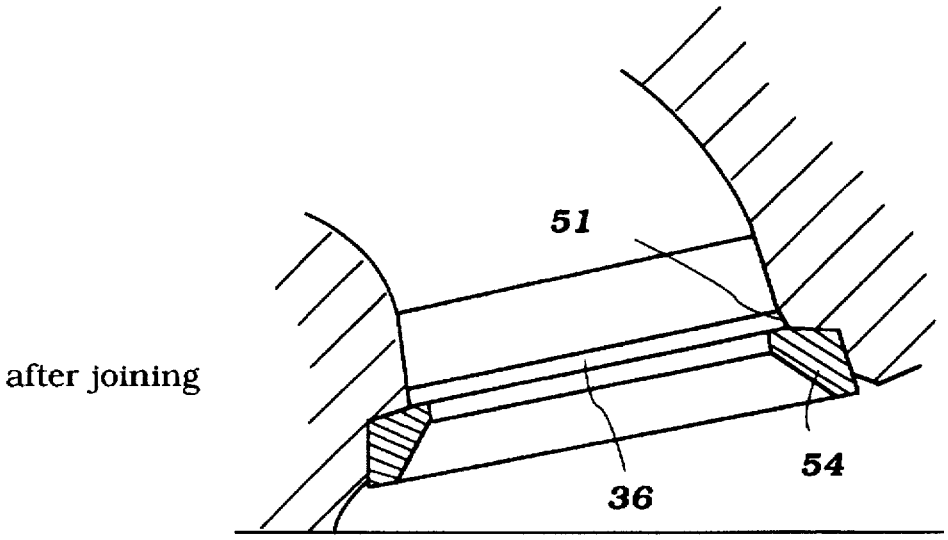
FIG. 6 is a cross-sectional view of the valve seat area for the intake flow passage and illustrates the condition when the insert is first installed.
Figure 7:
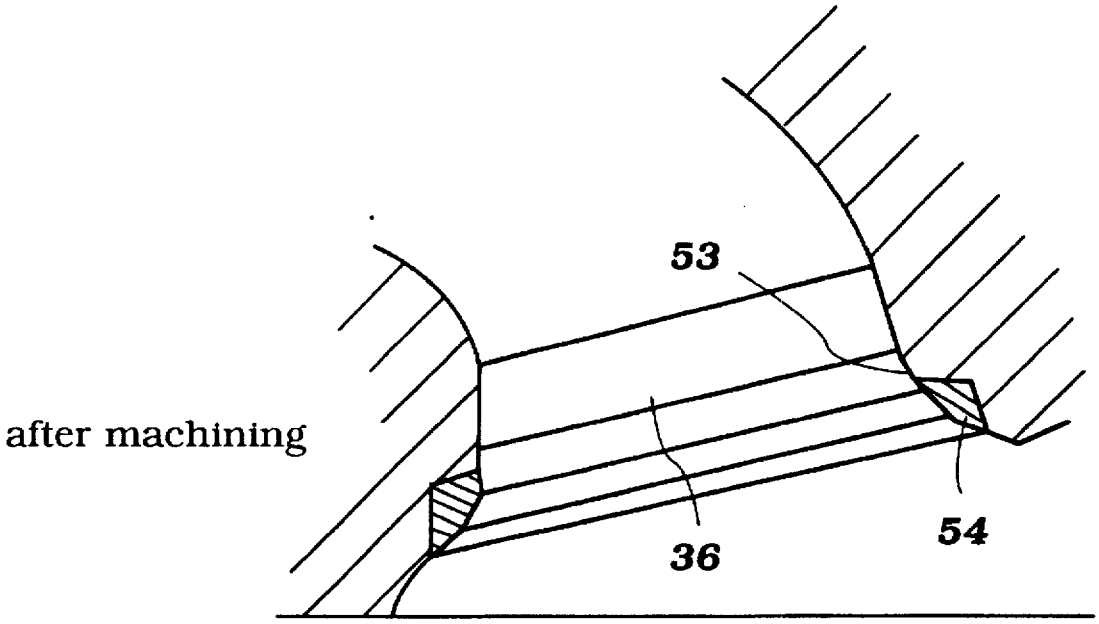
FIG. 7 is a cross-sectional view of the valve seat area for the intake flow passage and illustrates the final machined configuration of the valve seat.

The valve insert rings 54 are joined to the recesses 53 by a method that is illustrated for the intake flow passage only in FIGS. 5–7 and will now be described by reference thereto. In FIG. 5 it is seen that the tapered section 51 of the cylinder head intake flow passage 36 as formed before attachment of the insert ring 54 extends downwardly and terminates at the recess 34.

The insert ring 54 is then placed into engagement with this surface and an electrical current is passed through it and the cylinder head by the welding apparatus. The amount of heat applied causes the cylinder head material to plastically deform. The final bond is a metallurgical joining by solid phase diffusion at the boundary surface and not an alloying.

Once thus joined the surfaces are machined to form the final seating surface for the valve in the insert ring 54. In addition the insert ring 54 and cylinder head 31 are machine-operated upon until the outer surfaces blend smoothly to form the final flow passage 36 and recess 34 as seen in FIG. 7.

Because the insert rings 54 are metallurgically joined to the recesses 53 instead of being press-fitted it is possible to utilize smaller valve insert rings since they no longer need to be of a structure sufficient to tolerate the press-fitting process. This then reduces the possibility for cylinder head cracking between the insert rings 54 since more cylinder head material is disposed between successive insert rings 54 which are also no longer preloading this material. This also allows the water jackets 43 to be brought closer to the valves which increases the heat transfer from the valves and thus permits the utilization of lighter, smaller valves.

Finally, the smaller insert rings 54 reduce the height of the cylinder head 11 and eliminate the straight portion of the flow passages 36 and 38 as seen in FIG. 2. 36 is especially critical since the smaller angle results in a smoother curved flow passage where the flow enters and exits the combustion chamber at smaller $\alpha 1$ and $\alpha 2$ angles, respectively. The smaller $\alpha 1$ angle, the angle at which the flow enters the combustion chamber from the intake passages encourages tumbling flow into the combustion chamber.

Therefore, from the foregoing description, it should be readily apparent that the resulting cylinder head flow passages can be configured so as to provide the desired flow pattern into the chamber and permits the use of multiple closely positioned ports. In addition, the ports are configured so that there need not be any straight section and the configuration of the insert piece has not significant adverse effect on the flow. Of course, the foregoing description is that of a preferred embodiment of the invention. It will be readily apparent to those skilled in the art how various changes and modifications may be made from the described embodiment without departing from the spirit and scope of the invention, as defined by the appended claims.

What is claimed is:

1. A method for forming a cylinder head for a reciprocating machine, said method comprising the steps of forming a cylinder head from a first material and having a first external surface forming at, in part, a chamber of the reciprocating machine that varies cyclically in volume during the operation of the machine, forming a flow passage extending through said cylinder head from said first external surface to a second internal surface for interchange of fluids with the chamber during the initial forming of said cylinder head, subsequently machining a tapered opening in the end of said flow passage terminating at said first external surface, said machined tapered opening progressively increasing in diameter in the direction of said first external surface and which is adapted to receive an insert ring, rigidly affixing an insert ring into said cylinder head opening, and machining a valve seating surface in said insert ring for forming a final machined tapered opening that forms a continuous, uninterrupted curved passage with the flow passage of the cylinder head and for forming a valve seat for a poppet-type valve.

2. A method as set forth in claim 1 wherein the insert ring is metallurgically bonded to the cylinder head.

3. A method as set forth in claim 1 wherein the metallurgical bond is formed by applying pressure and heat to at least one of the insert ring and cylinder head for effecting metallurgical bonding of the materials of the insert ring and the cylinder head without alloying therebetween.

* * * * *